US010933273B2

(12) United States Patent
Liao et al.

(10) Patent No.: US 10,933,273 B2
(45) Date of Patent: Mar. 2, 2021

(54) STATIONARY EXERCISE APPARATUS

(71) Applicants: Hung-Mao Liao, Taichung (TW); Joe Chen, Taichung (TW)

(72) Inventors: Hung-Mao Liao, Taichung (TW); Joe Chen, Taichung (TW)

(73) Assignee: Johnson Health Tech. Co., Ltd., Taichung (TW)

( * ) Notice: Subject to any disclaimer, the term of this patent is extended or adjusted under 35 U.S.C. 154(b) by 0 days.

(21) Appl. No.: 16/233,089

(22) Filed: Dec. 27, 2018

(65) Prior Publication Data

US 2020/0206561 A1 Jul. 2, 2020

(51) Int. Cl.
*A63B 21/22* (2006.01)
*A63B 21/00* (2006.01)
(Continued)

(52) U.S. Cl.
CPC ..... *A63B 21/225* (2013.01); *A63B 21/00076* (2013.01); *A63B 21/154* (2013.01); *A63B 21/4034* (2015.10); *A63B 22/0017* (2015.10); *A63B 22/0056* (2013.01); *A63B 22/0664* (2013.01); *A63B 2022/0676* (2013.01)

(58) Field of Classification Search
CPC . A63B 22/0664; A63B 22/001; A63B 21/225; A63B 24/00; A63B 22/04; A63B 22/0015; A63B 22/0023; A63B 22/205; A63B 21/00; A63B 22/00; A63B 2225/09; A63B 2022/067–0688; A63B 2022/0053; A63B 22/0048; A63B 21/00076; A63B 22/0064; A63B 22/0017; A63B 22/0056; A63B 21/154; A63B 21/4034; A63B 2022/0676; A63B 2022/0682; A63B 22/208; A63B 2071/025
See application file for complete search history.

(56) References Cited

U.S. PATENT DOCUMENTS 5,540,637 A * 7/1996 Rodgers, Jr. ..... A63B 22/001 482/51
5,989,159 A * 11/1999 Chen ..... A63B 22/0664 482/51
(Continued)

FOREIGN PATENT DOCUMENTS

CN 108339235 A 7/2018

*Primary Examiner* — Jennifer Robertson
*Assistant Examiner* — Catrina A Letterman

(57) ABSTRACT

A stationary exercise apparatus includes two connecting members each having an upper end guided to move along a circular path and a lower end coupled to a swing member, so that when the upper end moves along the circular path, the lower end moves along an arc-shaped path. Two supporting members are configured to support a user's feet, which are coupled between the upper end and the lower end of the respective connecting members and movable along a closed path. Two control members each is arranged between the corresponding supporting member and the corresponding swing member for guiding the second portion of the corresponding supporting member along a predetermined path, so that an angle formed between each supporting member and the corresponding connecting member varies as the corresponding swing member moves along the arc-shaped path between a first endpoint and a second endpoint.

20 Claims, 15 Drawing Sheets

(51) Int. Cl.
*A63B 22/06* (2006.01)
*A63B 22/00* (2006.01)

(56) References Cited

U.S. PATENT DOCUMENTS

| | | | | |
|---|---|---|---|---|
| 6,440,042 | B2 * | 8/2002 | Eschenbach | A63B 22/001 482/51 |
| 9,199,115 | B2 | 12/2015 | Yim et al. | |
| 9,539,464 | B1 * | 1/2017 | Liu | A63B 21/00072 |
| 10,328,301 | B2 * | 6/2019 | Anderson | A63B 21/0051 |
| 2006/0199702 | A1 * | 9/2006 | Eschenbach | A63B 22/001 482/52 |
| 2009/0209394 | A1 * | 8/2009 | Kwon | A63B 22/001 482/52 |

* cited by examiner

STATIONARY EXERCISE APPARATUS

BACKGROUND

1. Field of the Invention

The present invention relates to an exercise apparatus. More particularly, the present invention relates to a stationary exercise apparatus for performing leg exercises.

2. Description of the Related Art

U.S. Pat. No. 9,199,115 discloses a stationary exercise apparatus that allows a user to perform a leg exercise. This exercise apparatus is a type of stepper device with two foot platforms that is well-known in the industry. As the user applies a portion of their bodyweight to a first foot platform, the first foot platform moves downward due to the weight of the user, and the second foot platform moves upward due to the design of the exercise apparatus. The user then shifts their weight to apply a portion of their bodyweight to the second foot platform, causing the second foot platform to move downward due to the weight of the user, and the first foot platform to move upward due to the design of the exercise apparatus.

In order to provide the aforementioned leg exercise, the prior art stationary exercise apparatus has a rotating mechanism, left and right guide rails, left and right reciprocating members, left and right rollers, and left and right foot platforms. Each guide rail is an inclined rod having an angle of inclination of substantially 60 degrees relative to a horizontal ground plane. The rotating mechanism is located above the guide rails. Each of the reciprocating members has an upper end coupled to a corresponding crank arm and a lower end with a roller that is slidable along the respective guide rail. When the upper ends of the reciprocating members cyclically move along a circular path guided by the crank arms, the rollers that couple to the lower ends of the respective reciprocating members are guided by the guide rails along a reciprocal path. The reciprocating members are coupled to the foot platforms for supporting a user's feet. When the left and right foot platforms are sequentially loaded, the foot platforms will alternately rise and fall in opposite directions so as to allow the user to perform leg exercises.

With this design, if a longer stride length and a higher lifting height are desired, it is necessary to use a longer crank arm to increase the displacement range of each foot platform. However, enlarging the circular path also creates a larger angular variation of each foot platform. This larger angular variation of each foot platform may cause a larger angular variation of the user's ankle joint, and the angle between the calf and the foot may exceed a proper ergonomic angle and may cause discomfort to the user's foot, or cause exercise injuries in tendons or ligaments. In contrast, if a shorter crank is used to limit angular variation of each foot platform within a suitable range, the leg stride length and the lifting height are relatively short and low so that the exercise difficulty and the benefits of the exercise are limited. In short, the stationary exercise apparatus disclosed in the prior art makes it difficult to balance both the longer stride length and the smaller (or appropriate) foot platform angular variation.

SUMMARY

The present invention is directed to a stationary exercise apparatus to allow a user to perform a leg exercise wherein each leg is alternately moved up and down, and the angular variation of the user's foot is controlled within a suitable range.

According to one aspect of the present invention, a stationary exercise apparatus comprises a frame, a crank mechanism, two connecting members, two swing members, two supporting members, and two control members. The crank mechanism is rotatably mounted on the frame about a first axis, and the first axis is oriented laterally with respect to the frame. Each of the two connecting members has a first portion, a second portion and a third portion. The first portion of each connecting member is coupled to the crank mechanism such that the crank mechanism guides the first portion of each connecting member to move along a circular path with respect to the frame. Each of the two swing members has a first portion, a second portion and a third portion. The first portion of each swing member is respectively pivotally mounted to the frame about a second axis, and the second axis is parallel to the first axis. The second portion of each swing member is coupled to the second portion of the respective connecting member for guiding the second portion of each connecting member to move along an arc-shaped path. When the first portion of each connecting member moves along the circular path, the second portion of each connecting member moves along the arc-shaped path between a first endpoint and a second endpoint, and the third portion of each connecting member moves along a closed path with respect to the frame. Each of the two supporting members is configured to support a user's foot. Each supporting member has a first portion and a second portion, and the first portion of each supporting member is coupled to the third portion of the respective connecting member.

Specifically, each of the two control members is arranged between the second portion of the corresponding supporting member and the third portion of the corresponding swing member. Each control member is configured to guide the second portion of the corresponding supporting member along a predetermined path, so that an angle formed between each supporting member and its corresponding connecting member varies as the corresponding swing member moves along the arc-shaped path between a first endpoint and a second endpoint.

Further benefits and advantages of the present invention will become apparent after a careful reading of the detailed description with appropriate reference to the accompanying drawings.

DETAIL DESCRIPTION

Figure 1:
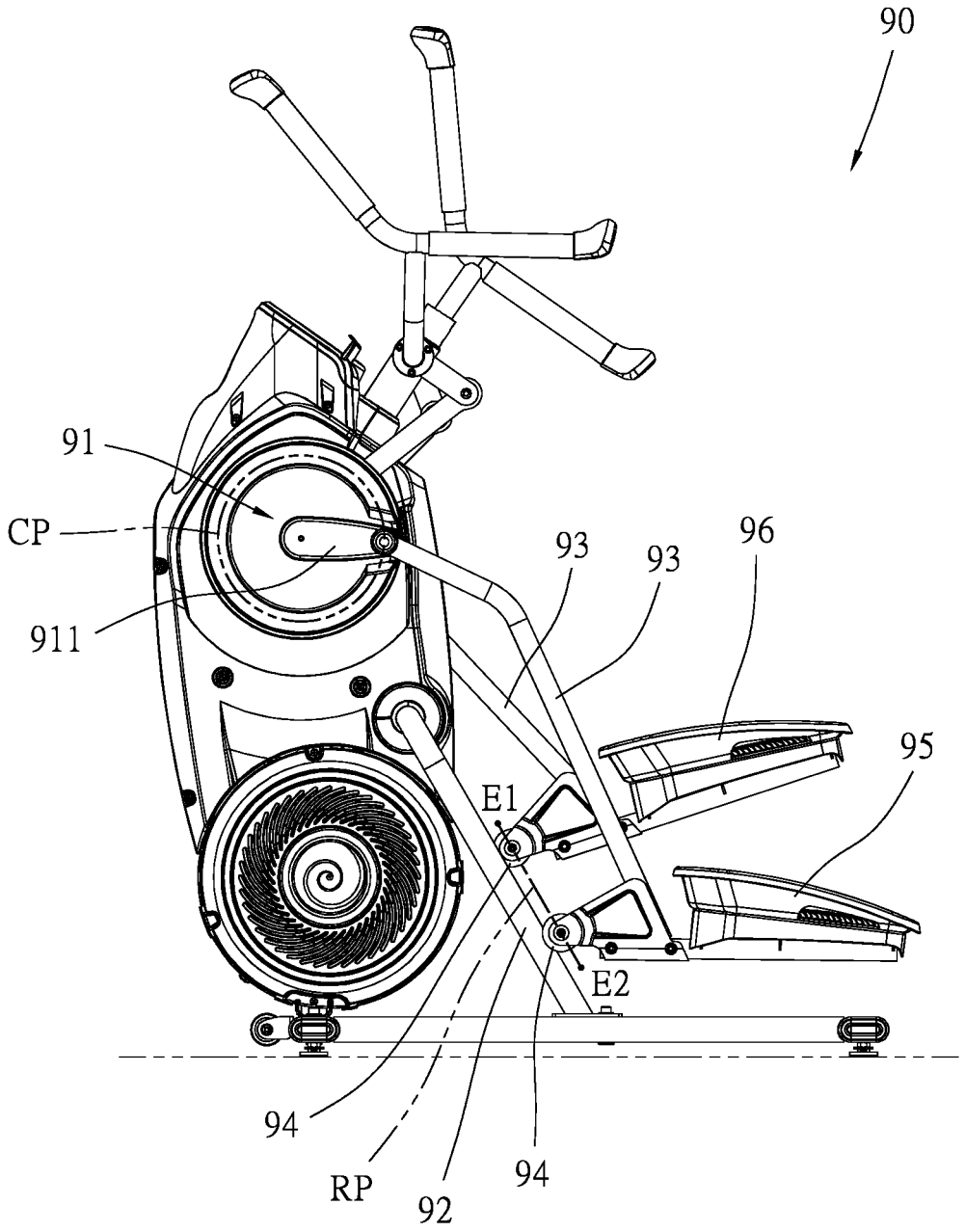
FIG. 1 (Prior Art)
FIG. 1 is a left side view of a prior art stationary exercise apparatus.

FIG. 1 provides a representation of a stationary exercise apparatus that is previously known in the industry. A very similar stationary exercise apparatus is disclosed in U.S. Pat. No. 9,199,115. FIG. 1 discloses a stationary exercise apparatus 90 that allows a user to perform a leg exercise. This exercise apparatus is a type of stepper device with two foot platforms that is well-known in the industry. As a user applies a portion of their bodyweight to a first foot platform 95, the first foot platform 95 moves downward due to the weight of the user, and the second foot platform 96 moves upward due to the design of the stationary exercise apparatus 90. The user then shifts their weight to apply a portion of their bodyweight to the second foot platform 96, causing the second foot platform 96 to move downward due to the weight of the user, and the first foot platform 95 to move upward due to the design of the stationary exercise apparatus 90. In order to provide the aforementioned leg exercise, the stationary exercise apparatus 90 has a rotating mechanism 91, left and right guide rails 92, left and right reciprocating members 93, left and right rollers 94, a first foot platform 95 and a second foot platform 96. Each guide rail 92 is an inclined rod having an angle of inclination of substantially 60 degrees relative to a horizontal ground plane. The rotating mechanism 91 is located above the guide rails 92. Each of the reciprocating members 93 has an upper end coupled to the outer end of the corresponding crank arm 911 and a lower end bent rearward, and the roller 94 is shown disposed in front of the bent portion of the respective reciprocating member 93 and is slidable along the respective guide rail 92. When the upper ends of the reciprocating members 93 cyclically move along a circular path CP guided by the crank arms 911, the rollers 94 that couple to the lower ends of the respective reciprocating members 93 are moved reciprocally between a first endpoint E1 and a second endpoint E2 of a reciprocating path RP guided by the guide rails 92. The reciprocating members 93 have rear ends that are coupled to the first foot platform 95 and the second foot platform 96 for supporting a user's feet. When the first foot platform 95 and the second foot platform 96 are sequentially loaded by at least a portion of a user's bodyweight, the first foot platform 95 and the second foot platform 96 will alternately rise and fall in opposite directions so as to allow the user to perform leg exercises.

During exercise, the displacement distance of each of the first foot platform 95 and second foot platform 96 (especially a front end, or toe supporting end, located closer to the aforementioned roller 94) is substantially equal to the distance between the first endpoint E1 and the second endpoint E2 of the aforementioned reciprocating path RP, and such distance is substantially equal to the diameter of the circular path CP. Since each of the first foot platform 95 and the second foot platform 96 is fixed to the respective reciprocating member 93, the relative angle between a front end and a rear end of each of the first foot platform 95 and the second foot platform 96 is periodically changed along with the periodic variation of the relative angle between the upper and lower end of the respective reciprocating member 93 during exercise. For example, the rear end (or heel end) is raised to a maximum height relative to the front end (or toe end) during the ascent period of each of the first foot platform 95 and the second foot platform 96, and the rear end (heel end) is lowered to a minimum height relative to the front end (toe end) during the descent period of each of the first foot platform 95 and the second foot platform 96. The angular difference therebetween is equal to the angular variation between the upper end and the lower end of each reciprocating member 93. The angular variation between the upper end and the lower end of each reciprocating members 93 is increased or decreased with the size of the circular path CP. In other words, when the circular path CP is larger, the maximum height will be higher, the minimum height will be lower, and the angular variation will be greater.

Based on the above described features of the aforementioned stationary exercise apparatus 90, if it is desired to provide leg movement with a longer stride length and a higher lifting height, it is necessary to lengthen the diameter of the circular path CP. That is, it is necessary to use a longer crank arm 911 to increase the displacement range of each of the first foot platform 95 and the second foot platform 96. However, enlarging the circular path also creates a larger angular variation of each of the first foot platform 95 and the second foot platform 96. This larger angular variation may cause a larger angular movement of the user's ankle joint, and the angle between the calf and the foot may exceed a proper ergonomic angle. This may cause discomfort to the user's foot, or cause exercise injuries in tendons or ligaments. In contrast, if a shorter crank is used to limit angular variation of each of the first foot platform 95 and the second foot platform 96 within a suitable range, the leg stride length and the lifting height are relatively short and low so that the exercise difficulty and benefits of the exercise are limited. In short, the stationary exercise apparatus 90 shown in FIG. 1 makes it difficult to balance both the longer stride length and the smaller (or appropriate) foot platform angular variation.

Referring to FIG. 2 through FIG. 5, a stationary exercise apparatus 10A in accordance with a first preferred embodiment of the present invention comprises a frame 20 having a base unit 22 adapted to be stably rested on a ground plane G, and a frame unit 24 fixed on the base unit 22. The frame unit 24 has a first rod 241, a second rod 242, a third rod 243, a fourth rod 244 and a fifth rod 245. The first rod 241 extends upward and rearward from the front end of the base unit 22. The second rod 242 extends frontward horizontally from the top end of the first rod 241. The third rod 243 extends upward and rearward from the front end of the second rod 242. The fourth rod 244 extends upward and frontward from the middle portion of the base unit 22 to the middle portion of the first rod 241. The fifth rod 245 extends upward and frontward from the middle portion of the first rod 241 to the front end of the second rod 242. Furthermore, a handle set 26 is mounted near the top end of the third rod 243 for being held by a user during exercise and a console 46 is mounted on the top end of the third rod 243.

Figure 2:
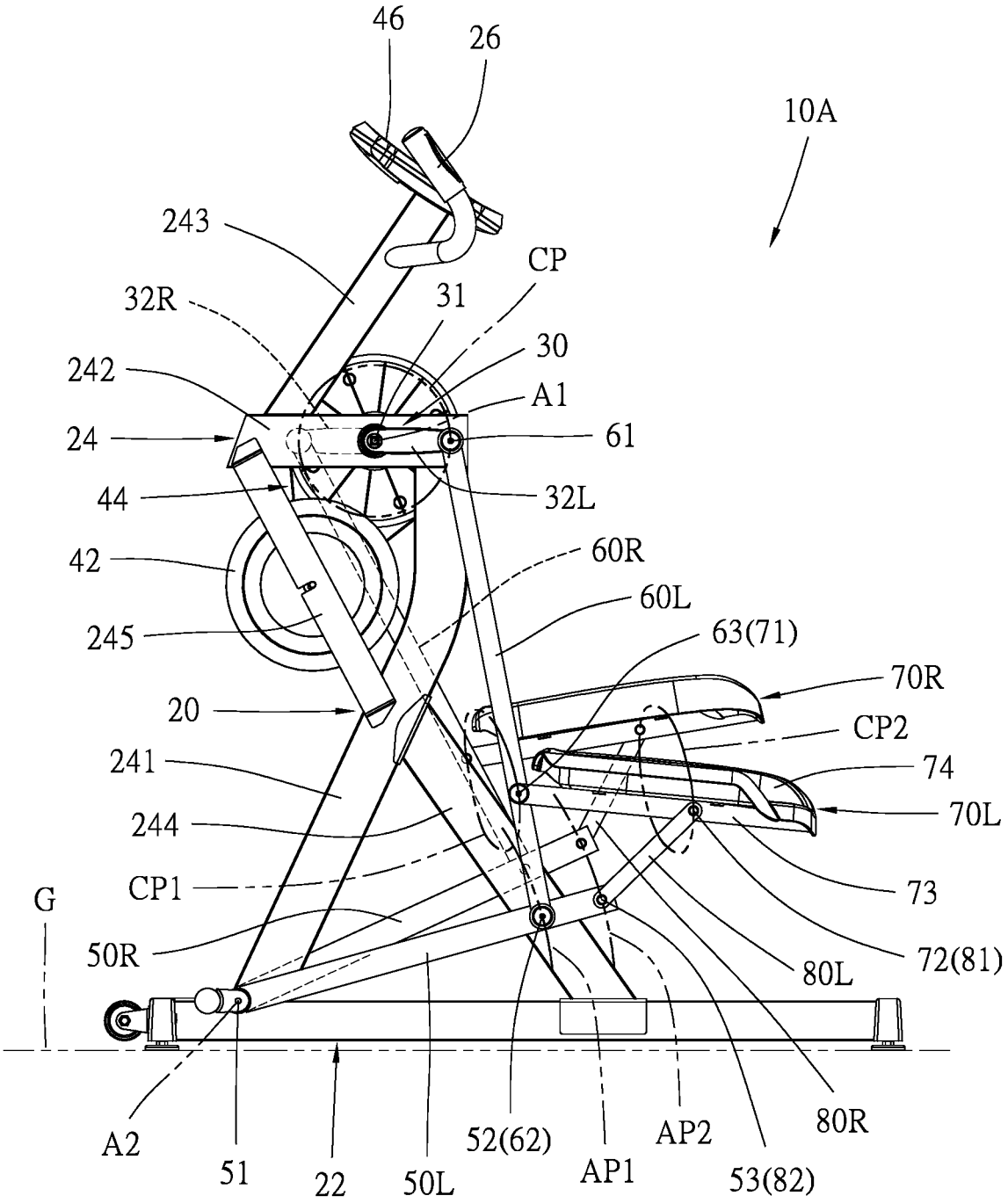
FIG. 2 to FIG. 5 are left side views of a stationary exercise apparatus in accordance with a first preferred embodiment of the present invention, respectively showing states of two foot platforms at four different positions.
Figure 3:
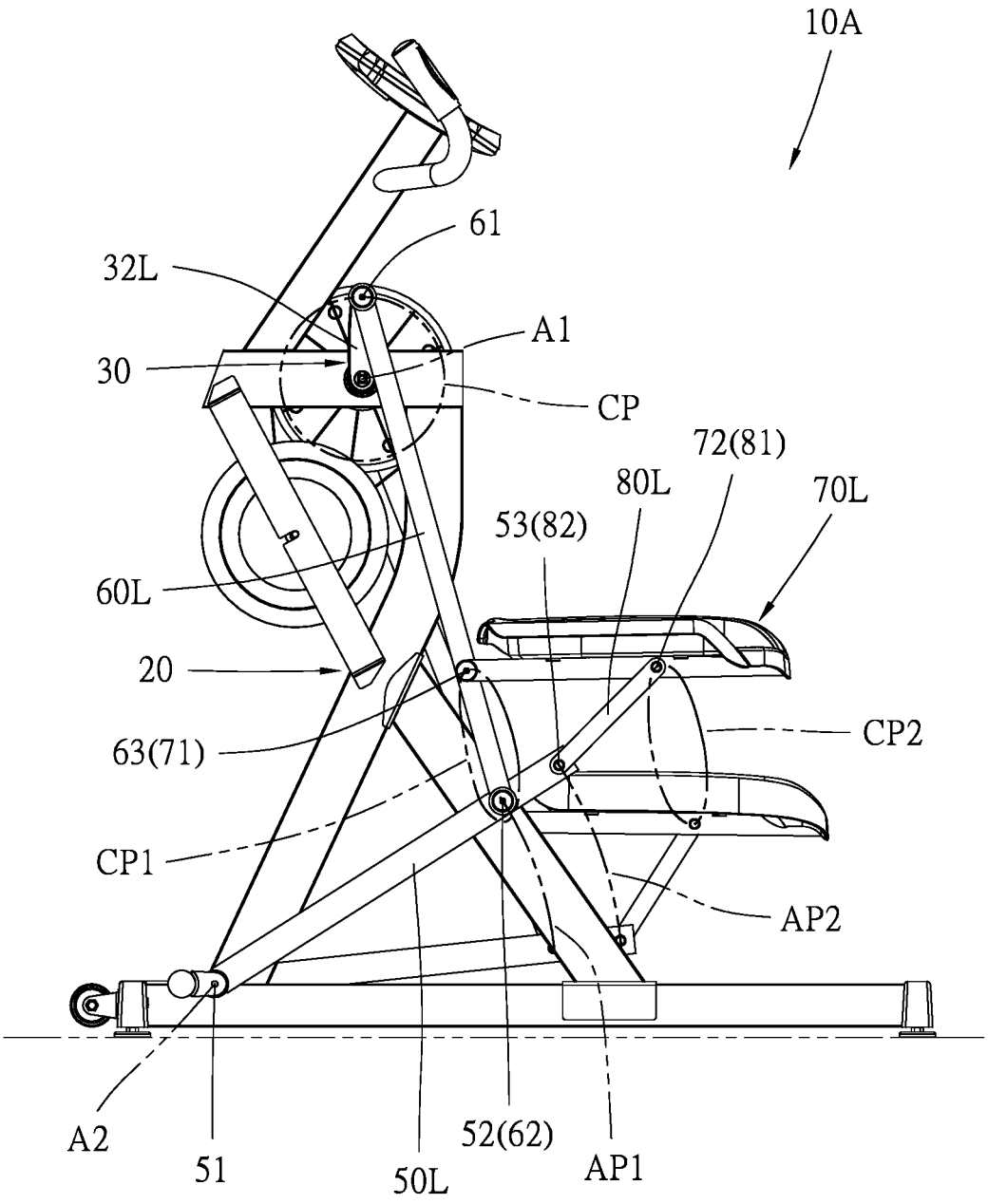
Figure 4:
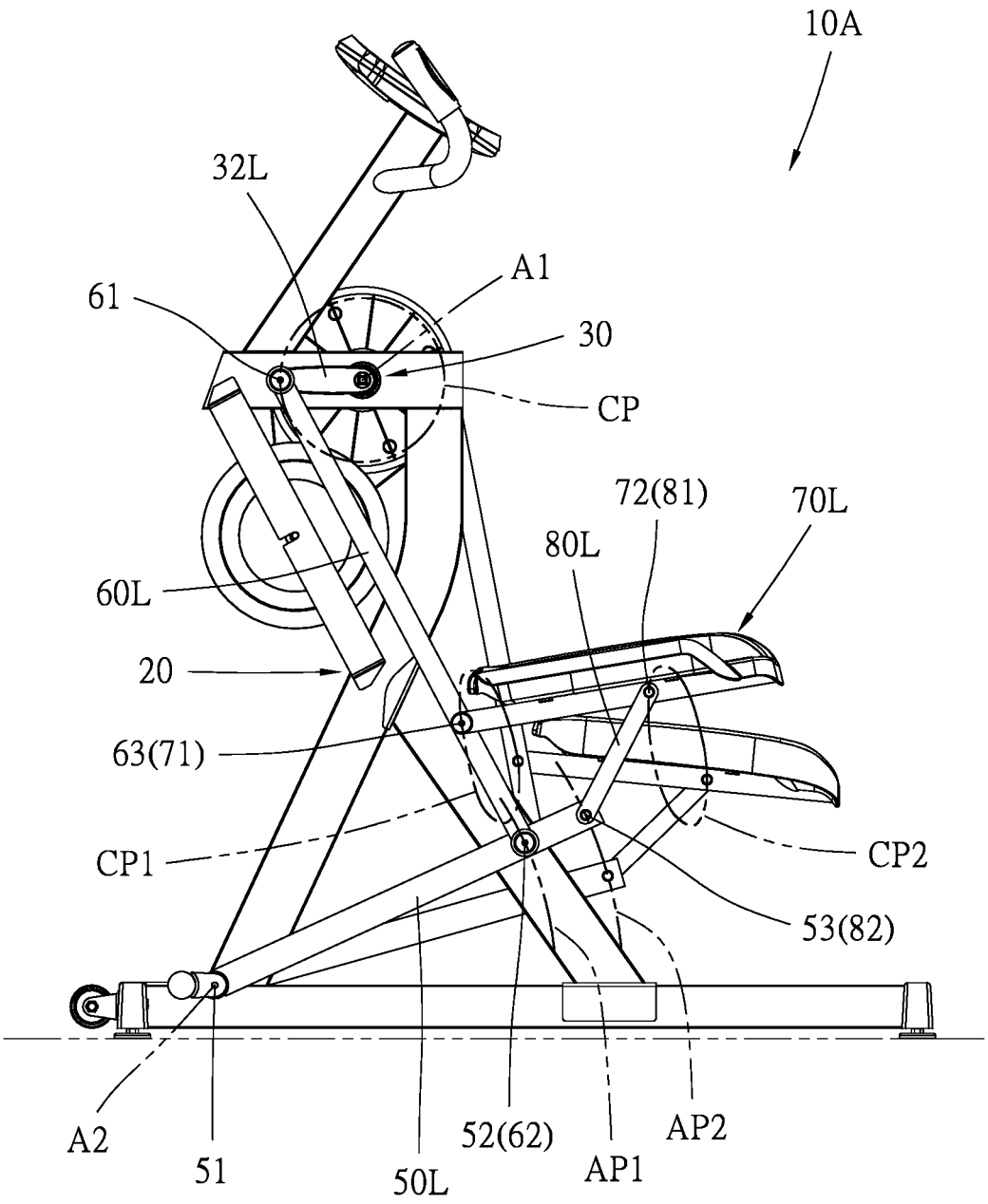
Figure 5:
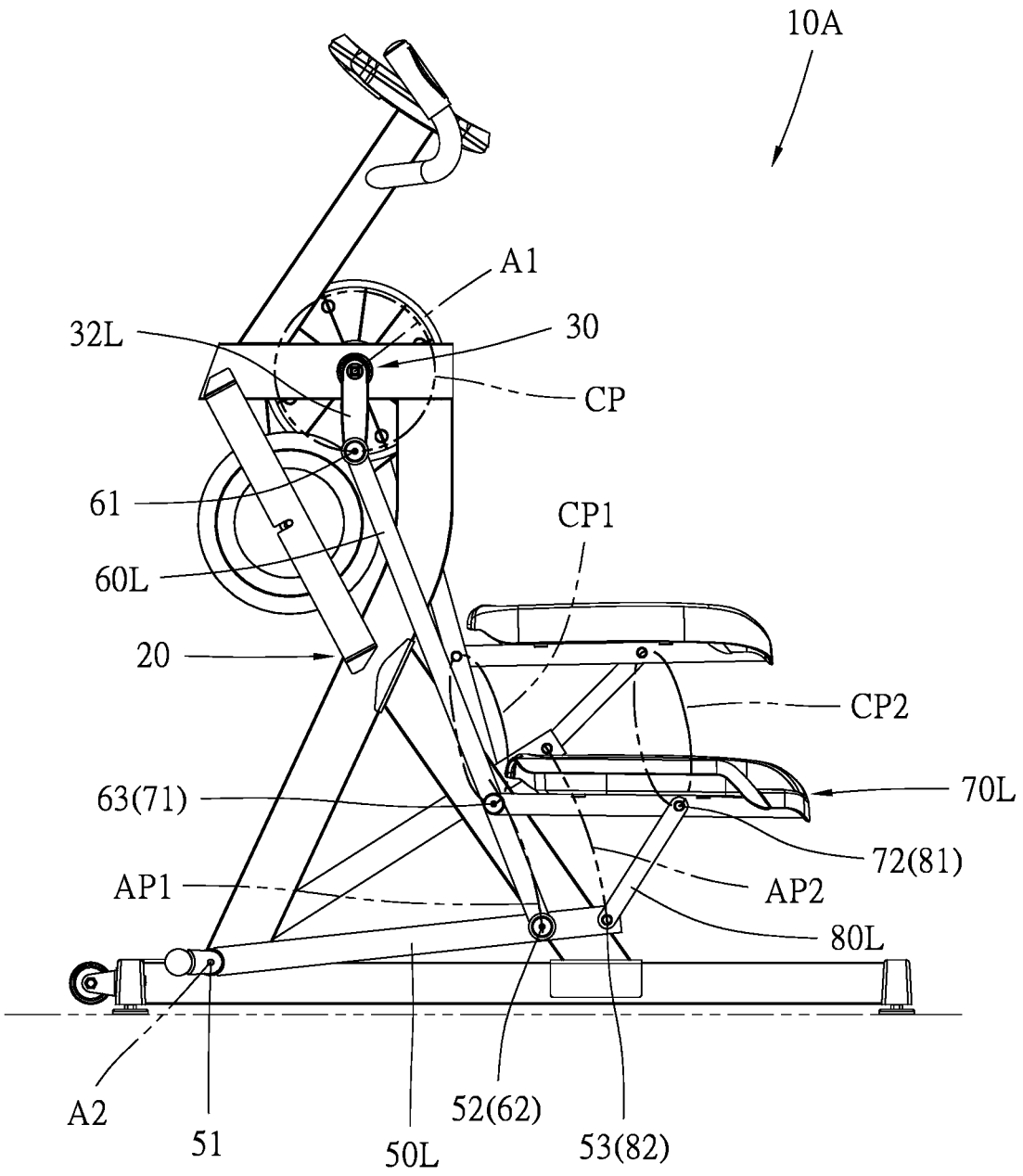

In the preferred embodiment of the present invention, the stationary exercise apparatus 10A has a rotating mechanism such as a crank mechanism 30 mounted on the frame unit 24 about a first axis A1. Referring to FIG. 2, the crank mechanism 30 has a crank shaft 31 and left and right crank arms 32L, 32R. The crank shaft 31 is disposed at an approximate central position of the second rod 242 of the frame unit 24 and is rotatable about the first axis A1 which is oriented laterally with respect to the frame. The left and right crank arms 32L, 32R are perpendicularly secured to the left and right ends of the crank shaft 31, such that the two crank arms 32L, 32R are extended radially outward from the respective ends of the crank shaft 31 in opposite direction, namely, in the side view, the outer ends of the left and right crank arms 32L, 32R are maintained at 180 degrees opposite to each other with respect to the axis of the crank shaft 31.

A flywheel 42 is arranged below the crank mechanism 30. The flywheel 42 is also pivotally mounted on the frame unit 24 with an axis oriented laterally with respect to the frame. The flywheel 42 and the crank shaft 31 are connected by a belt transmission mechanism 44. When the crank mechanism 30 is driven by an external force to rotate, the flywheel 42 rotates at a faster speed to provide an appropriate rotating load and movement of inertia, so that the rotation of the crank mechanism 30 would be more stable and smooth. Preferably, the stationary exercise apparatus 10A may also be provided with a resistance device (not shown) cooperating with the flywheel 42 or connected to the crank mechanism 30, such as an eddy current brake, a generator brake, a friction brake, a water resistance device, a wind resistance device for generating a resistance which could be adjusted by a user, and thereby (through the console 46) to set the force required for driving the crank mechanism 30, namely to set the difficulty level of the movement. However, the structure and operation of the resistance device are conventional techniques that are well known in the art, the detailed description is not mentioned in the present invention.

The stationary exercise apparatus 10A has symmetrical left and right swing members 50L, 50R. In the preferred embodiment, each swing member 50L or 50R is a rod having a front end and a rear end. The front end forms a first portion 51 of each swing member 50L or 50R, a predetermined portion between the front end and the rear end forms a second portion 52 of each swing member 50L or 50R, and the rear end forms a third portion 53 of each swing member 50L or 50R. The first portions 51 of the left and right swing members 50L, 50R are pivotally mounted on the front end of the base unit 22 of the frame 20 about a second axis A2, so that the left and right swing members 50L, 50R are able to swing about the second axis A2 which is parallel to the first axis A1, namely pivotable about the respective first portions 51 with respect to the frame 20.

The stationary exercise apparatus 10A has symmetrical left and right connecting members 60L, 60R. In the preferred embodiment, each connecting member 60L or 60R is a rod having an upper end and a lower end. The upper end forms a first portion 61 of each connecting member 60L or 60R, the lower end forms a second portion 62 of each connecting member 60L or 60R, and a predetermined portion between the upper end and the lower end forms a third portion of each connecting member 60L or 60R. The first portion 61 of each connecting members 60L or 60R is coupled to the outer end of the respective crank arm 32L or 32R according to an axis oriented laterally with respect to the frame, as shown in FIG. 2. The second portion 62 of each connecting members 60L or 60R is coupled to the second portion 52 of the respective swing member 50L, 50R according to an axis oriented laterally with respect to the frame.

Figure 6:
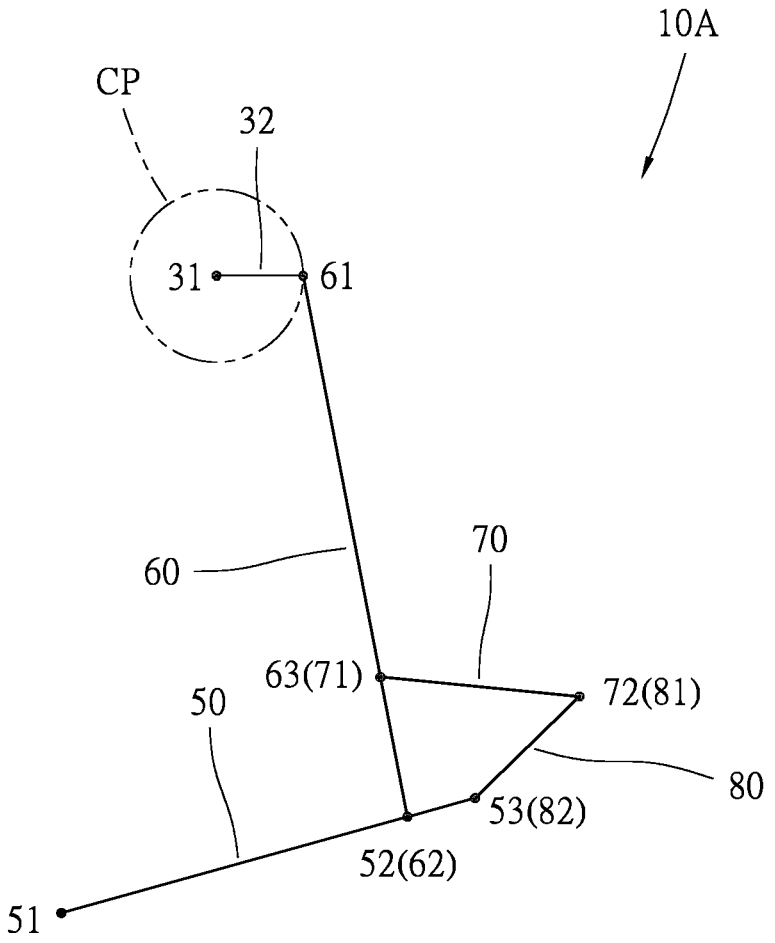
FIG. 6 is a schematic drawing for illustrating the relationship between the components on one side (left side is shown) of the stationary exercise apparatus according to the first preferred embodiment.

FIG. 6 is a schematic drawing for illustrating the relationship between the components at one side of the stationary exercise apparatus 10A. On either side of the stationary exercise apparatus 10A, a planar four-bar linkage is constructed from four links connected in a loop. The four links comprise a first link, a second link, a third link and a fourth link. The first link is assumed from the position of the crank shaft 31 to the position of the first portion 51 of the swing member 50, the second link is defined by the crank arm (labeled 32 in FIG. 6), the third link is defined from the first portion 51 to the second portion 52 of the swing member 50 (labeled 50 in FIG. 6), and the fourth link is defined from the first portion 61 to the second portion 62 of the connecting member (labeled 60 in FIG. 6). Both the position of the crank shaft 31 and the position of the first portion 51 of the swing member 50 are belonged to the frame 20, such that the first link defined from the crank shaft 31 to the first portion 51 of the swing member 50 is regard as a fixed link of the planar four-bar linkage. Besides, the length relationship of the first links satisfies a specific "Grashof condition", so that the planar four-bar linkage forms a crank-rocker mechanism. In detail, as shown in FIG. 2 to FIG. 5, the first portions of the connecting members 60L, 60R can be fully rotated by 360 degrees along with the outer ends of the crank arms 32L, 32R. When the first portions 61 of the connecting members 60L, 60R revolve along a circular path CP guided by the crank arms 32L, 32R, the second portions 62 of the connecting members 60L, 60R are reciprocated between a first endpoint and a second endpoint of a first arc-shaped path AP1 guided by the swing members 50L, 50R. Preferably, the first endpoint (namely the upper end of the first arc-shaped path AP1) is located higher than the second endpoint (namely the lower end of the first arc-shaped path AP1), and a line connecting the first endpoint and the second endpoint of the arc-shaped path defines an angle with a horizontal plane (e.g. grand G). The angle between the line and the horizontal plane is greater than 45 degrees. Furthermore, the first arc-shaped path AP1 is entirely located below the lowermost point of the circular path CP, and the first arc-shaped path AP1 is located closer to the rear than the center of the circular path CP (namely the axis of the crank shaft 31).

Referring to FIGS. 2 through 5, the first portion 61 and the second portion 62 of each connecting member 60L or 60R are respectively guided to move along the circular path CP and the first arc-shaped path AP1, and the third portion 63 of each connecting member 60L or 60R is restricted to move along a first closed path CP1 with respect to the frame 20. In other words, when the third portion 63 of each connecting member 60L or 60R moves along the first closed path CP1 for one turn, the first portion 61 of the respective connecting member 60L or 60R moves along the circular path CP for one turn and the second portion 62 of the respective connecting member 60L or 60R reciprocates along the first arc-shaped path AP1 once. The first closed path CP1 is a substantially elongated elliptical in shape and the included angle between its major axis direction and the horizontal plane is greater than 45 degrees. Besides, the vertical distance between the uppermost point and the lowermost point of the first closed path CP1 is greater than the horizontal distance between the foremost point and the rearmost point of the first closed path.

In side view, since the first portions 61 of the left and right connecting members 60L, 60R are maintained at 180 degrees opposite to each other on the circular path CP, the second portions 62 of the two connecting members 60L, 60R are substantially maintained at opposite positions on the first arc-shaped path AP1, and the third portions 63 of the two connecting members 60L, 60R are also substantially maintained at opposite positions on the first closed path CP1 correspondingly. For example, when the third portion 63 of one connecting member 60L or 60R is located at the top end/bottom end of the first closed path CP1, the third portion 63 of the other connecting member 60L or 60R is substantially located at the opposite bottom end/top end of the first closed path CP1. Furthermore, assuming the first portions 61 of the connecting members 60L, 60R are rotated in a counterclockwise direction along the circular path CP, then, when the third portion 63 of one connecting member 60L or 60R moves frontward and upward at a rear half part of the first closed path CP1, the third portion 63 of the other connecting member 60L or 60R moves rearward and downward at a front half part of the first closed path CP1.

During the cyclic movement period of the first portions 61 of the two connecting members 60L, 60R rotating along the circular path CP, the two swing members 50L, 50R will reciprocally swing correspondingly, so that the third portions 53 of the swing members 50L, 50R are reciprocated along a second arc-shaped path AP2, and the relative angle between the swing member 50L or 50R and the connecting member 60L or 60R at the same side also correspondingly changes periodically.

The stationary exercise apparatus 10A has symmetrical left and right supporting members 70L, 70R configured to support a user's left and right feet respectively and directly bear the force applied by the user's feet. Each supporting member 70L or 70R has a supporting base 73 and a foot platform 74 fixed on the supporting base 73. The front end of the supporting base 73 forms a first portion 71 of the respective supporting member 70L or 70R, and the approximately central portion of the supporting base 73 forms a second portion 72 of the respective supporting member 70L or 70R. The first portion 71 of each supporting member 70L or 70R is coupled to the third portion 63 of the respective connecting member 60L or 60R according to an axis oriented laterally with respect to the frame, so that each supporting members 70L or 70R is pivotable about its first portions 71 with respect to the corresponding connecting member 60L or 60R.

The stationary exercise apparatus 10A has symmetrical left and right control members 80L, 80R. Each of the two control members 80L, 80R is arranged between the second portion 72 of the corresponding supporting member 70L or 70R and the third portion 53 of the corresponding swing member 50L or 50R for guiding relative movement between the second portion 72 of the corresponding supporting member 70L or 70R and the third portion 53 of the corresponding swing member 50L or 50R in a predetermined path, such that the angle of each supporting member 70L or 70R relative to the corresponding connecting member 60L or 60R varies with the angle of the respective swing member 50L or 50R relative to the corresponding connecting member 60L or 60R. In the preferred embodiment, each control member 80L or 80R is a rod having an upper end and a lower end. The upper end forms a first portion 81 of the respective control member 80L or 80R, and the lower end forms a second portion 82 of the respective control member 80L or 80R. The first portion 81 of each control member 80L or 80R is coupled to the second portion 72 of the corresponding supporting member 70L or 70R according to an axis oriented laterally with respect to the frame, and the second portion 82 of each control member 80L or 80R is coupled to the third portion 53 of the corresponding swing member 50L or 50R according to an axis oriented laterally with respect to the frame.

Referring to FIG. 6, on either side of the stationary exercise apparatus 10A, the connecting member 60 forms a first link from the second portion 62 to the third portion 63 thereof, the swing member 50 forms a second link from the second portion 52 to the third portion 53 thereof, the supporting member 70 forms a third link from the first portion 71 to the second portion 72 thereof, and the control member 80 forms a fourth link from the first portion 81 to the second portion 82 thereof Such four links together constitute another (second) planar four-bar linkage mechanism. The first link (the connecting member 60), the second link (the swing member 50), the third link (the supporting member 70) and the fourth link (the control member 80) are able to respectively regard as a frame, an input link, an output link and a coupler of the aforementioned (second) planar four-bar linkage mechanism, namely, the angle of the supporting member 70 relative to the connecting member 60 varies with the angle the swing member 50 relative to the connecting member 60, so that during the cyclic movement period of the first portion 61 of the connecting member 60 rotating along the circular path, since the angle of the swing member 50 relative to the connecting member 60 changed periodically, the angle of the supporting member 70 relative to the connecting member 60 changes periodically as well.

When the first portion 71 of the supporting member 70 moves along the first closed path CP1 for one turn, the second portion 72 of the supporting member 70 moves along a second closed path CP2 which is similar to the shape of the first closed path CP1 for one turn. It is conceivable that any part of the supporting member 70 moves along a similar closed path, except that the movement speeds of the front end and the rear end of the supporting member 70 are not completely identical, and therefore the relative angle between the front end and the rear end will change cyclically in the aforementioned cyclic motion. In the preferred embodiment, during the cyclic movement period of the first portion 61 of each connecting member 60L, 60R rotating along the circular path CP, the maximum angular variation of each supporting member 70 relative to the frame 20 (or ground plane G) is smaller than the maximum angular variation of each connecting member 60L, 60R relative to the frame 20 (or ground plane G).

Figure 7:
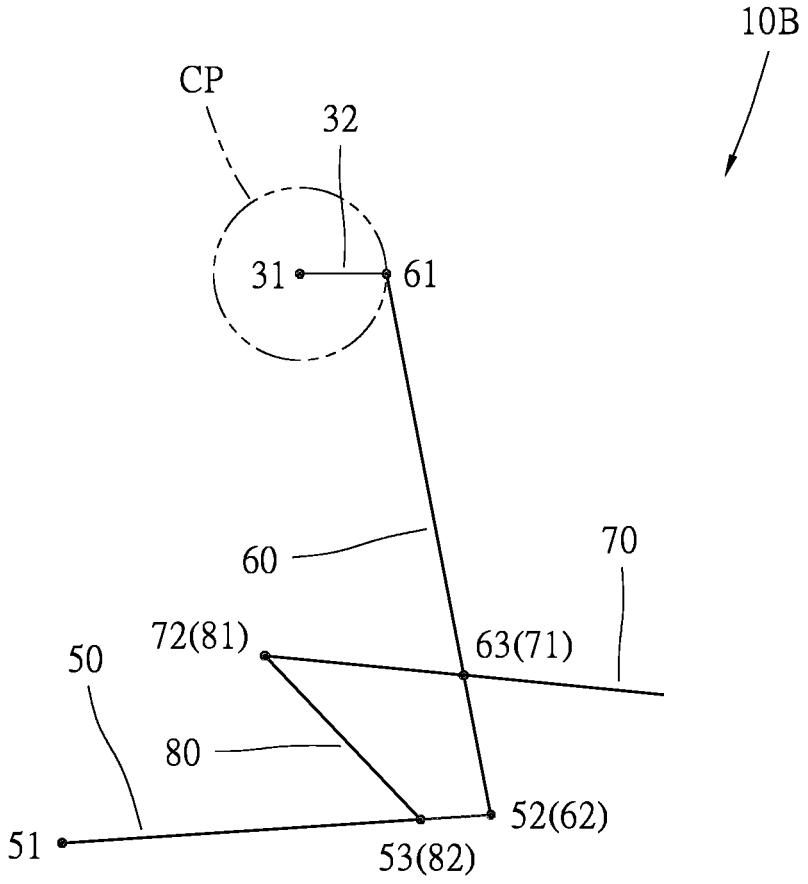
FIG. 7 to FIG. 9 are similar to FIG. 6 for illustrating modified embodiments of the stationary exercise apparatus according to the first preferred embodiment.
Figure 8:
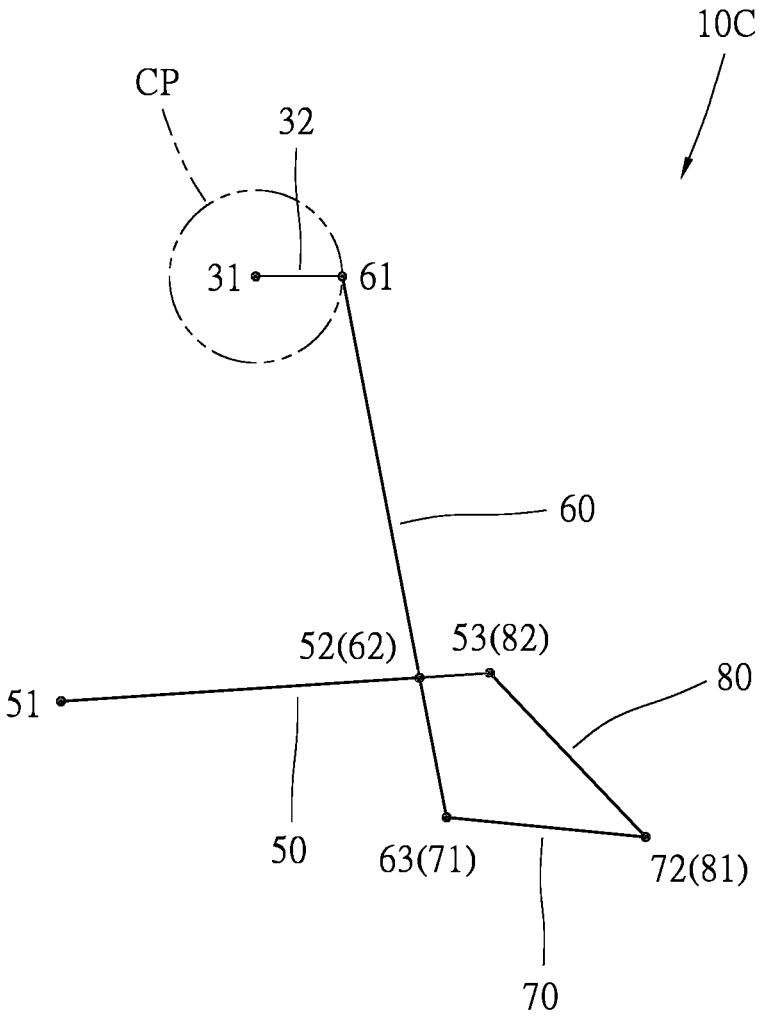
Figure 9:
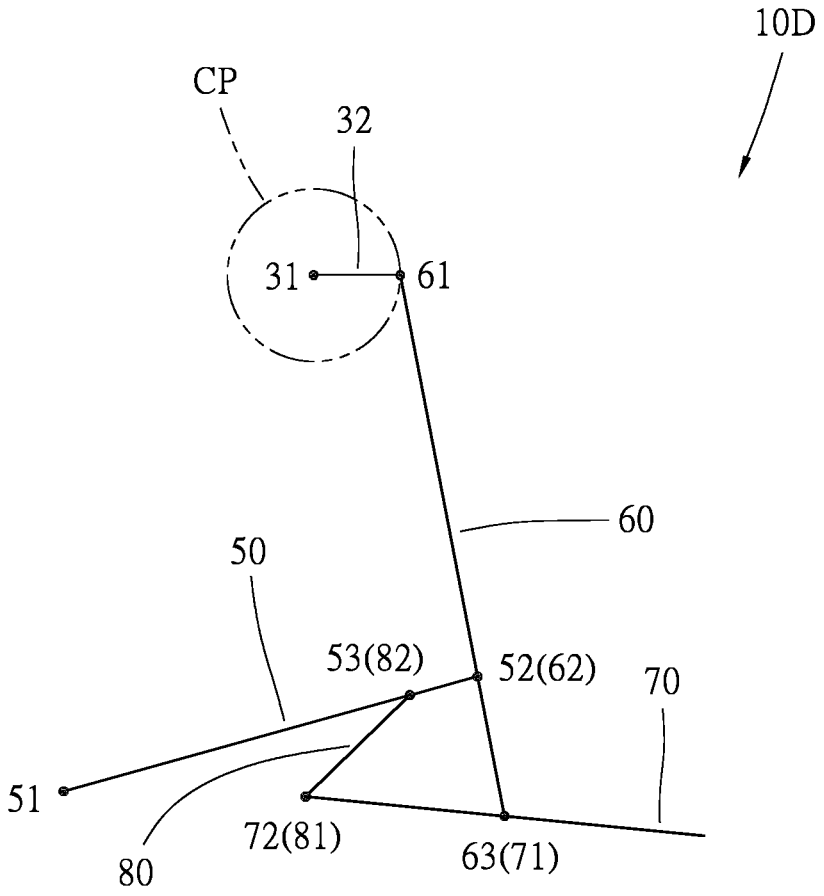

In practice, the structure of the stationary exercise apparatus 10A as shown in FIG. 2 through FIG. 6 such as spatial relationship of each pivotal part is able to be adjusted or modified according to design requirements. For example, in a stationary exercise apparatus 10B illustrated in FIG. 7, the third portion 53 where the swing member 50 is coupled to the control member 80 is located not behind but in front of the second portion 52 where the swing member 50 is coupled to the connecting member 60, and the second portion 72 where the supporting member 70 is coupled to the control member 80 is located not behind but in front of the first portion 71 where the supporting member 70 is coupled to the connecting member 60. In brief, the control member 80 is located not behind but in front of the connecting member 60, but the function is the same as above. In a stationary exercise apparatus 10C illustrated in FIG. 8, the second portion 62 where the connecting member 60 is coupled to the swing member 50 is located between the upper end and the lower end of the connecting member 60 (also moving along an arc-shaped path), and the third portion 63 where the connecting member 60 is coupled to the supporting member 70 is located at the lower end of the connecting member 60 (also moving along a closed path), such that the supporting member 70 is located at a lower position closer to the ground plane. In a stationary exercise apparatus 10D illustrated in FIG. 9, the control member 80 is located in front of the connecting member 60 and the supporting member 70 is located below the swing member 50. Incidentally, in the above figures, the first, second and third portions 51, 52, 53 of the swing member 50 are collinear, and the first, second and third portions 61, 62, 63 of the connecting member 60 are also collinear, but this is just for the convenience of illustration (especially FIGS. 6 to 9), not the necessary conditions of the present invention.

In the FIG. 6 to FIG. 9, the connecting member 60, the swing member 50, the supporting member 70 and the control member 80 together constitute a planar four-bar linkage mechanism. The lengths of the first link, the second link, the third link and the fourth link projected on the respective movement planes are defined as a first link length, a second link length, a third link length and a fourth link length. The third link length namely the length between first portion 71 and the second portion 72 of the supporting member 70 is greater than the second link length namely the length between the second portion 52 and the third portion 53 of the swing member 50, so that the maximum angular variation can be reduced. In another embodiment of the present invention (not shown), the sum of the lengths of the longest and the shortest of the aforementioned first, second, third and fourth link length is greater than the sum of the lengths of the other two for being able to prevent the supporting member 70 and the control member 80 from being unintended deflection or locking.

Referring to FIG. 10 through FIG. 13, a stationary exercise apparatus 10E in accordance with a second preferred embodiment of the present invention is similar to the stationary exercise apparatus 10A of the first preferred embodiment. The stationary exercise apparatus 10E has a frame 20', a crank mechanism 30', left and right swing members 50L' and 50R', left and right connecting members 60L' and 60R', left and right supporting members 70L' and 70R', and left and right control members 80L' and 80R'. The main difference between the second preferred embodiment and the first preferred embodiment is that each control member 80L' or 80R' is a wedge-shaped block secured on the second portion 72' of the supporting member 70L' or 70R' namely the rear end of the supporting member 70L' or 70R' in the present embodiment. The wedge-shaped block has a sliding plane 83' toward the corresponding swing member 50L' or 50R'. Correspondingly, each swing member 50L' or 50R' has a roller 85' pivotally mounted on the third portion 53' of each swing member 50L' or 50R' for abutting against the sliding plane 83' and being configured to roll on the sliding plane 83'. As shown in FIGS. 10 to 13, when the first portion 61' of the connecting member 60L' or 60R' is cyclically rotated along the circular path CP' such that the relative angle between the swing member 50L' or 50R' and the connecting member 60L' or 60R' changes periodically, the third portion 53' of the swing member 50L' or 50R' is reciprocated along an arc-shaped path AP2' and the second portion 72' of the corresponding supporting member 70L' or 70R' is moved along a predetermined path defined by the sliding plane 83', so that the angle of the supporting member 70L' or 70R' relative to the connecting member 60L' or 60R' varies with the angle of the swing member 50L' or 50R' relative to the connecting member 60L' or 60R'.

Figure 10:
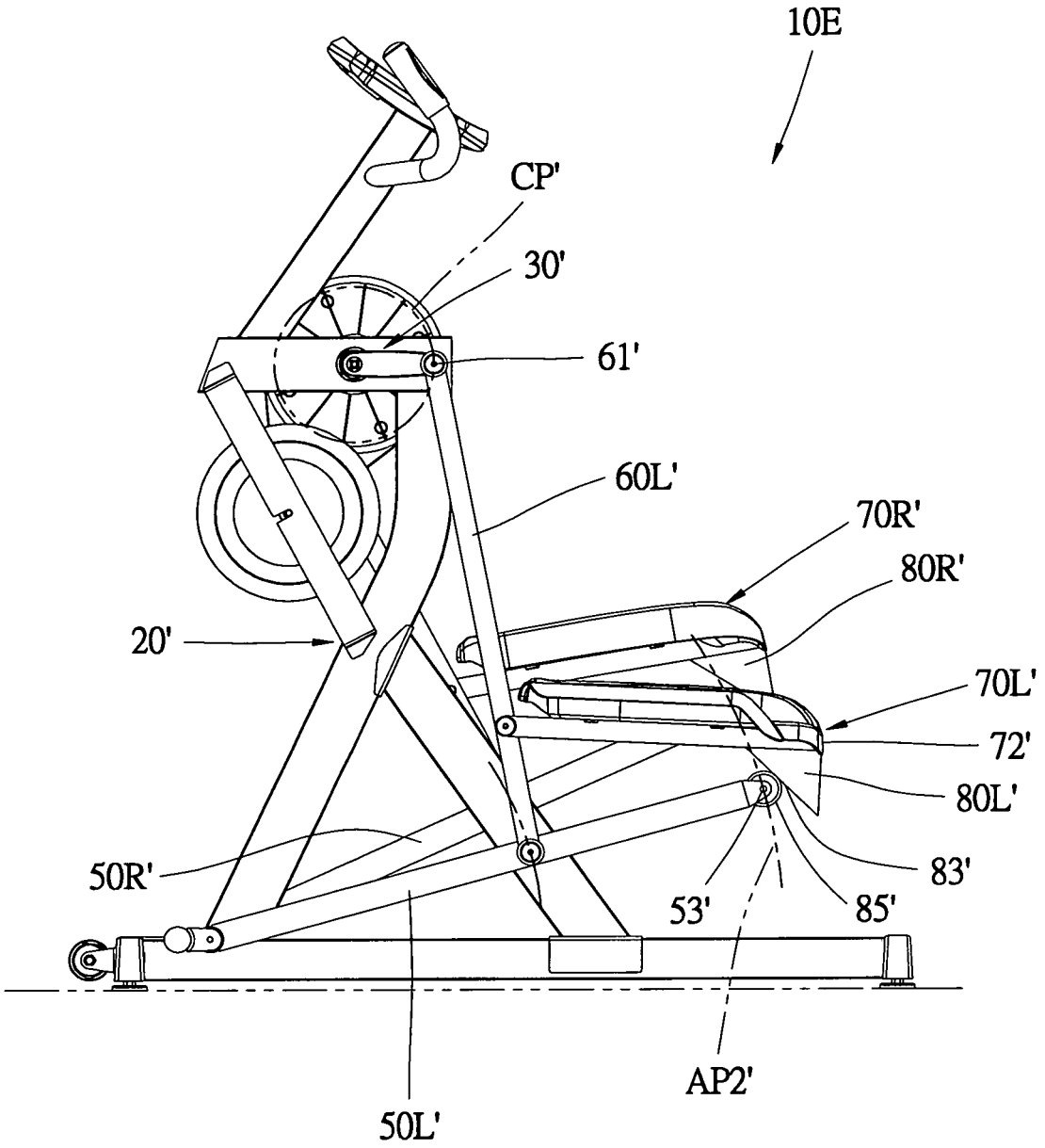
FIG. 10 to FIG. 13 are left side views of a stationary exercise apparatus in accordance with a second preferred embodiment of the present invention, respectively showing states of two foot platforms at four different positions.
Figure 11:
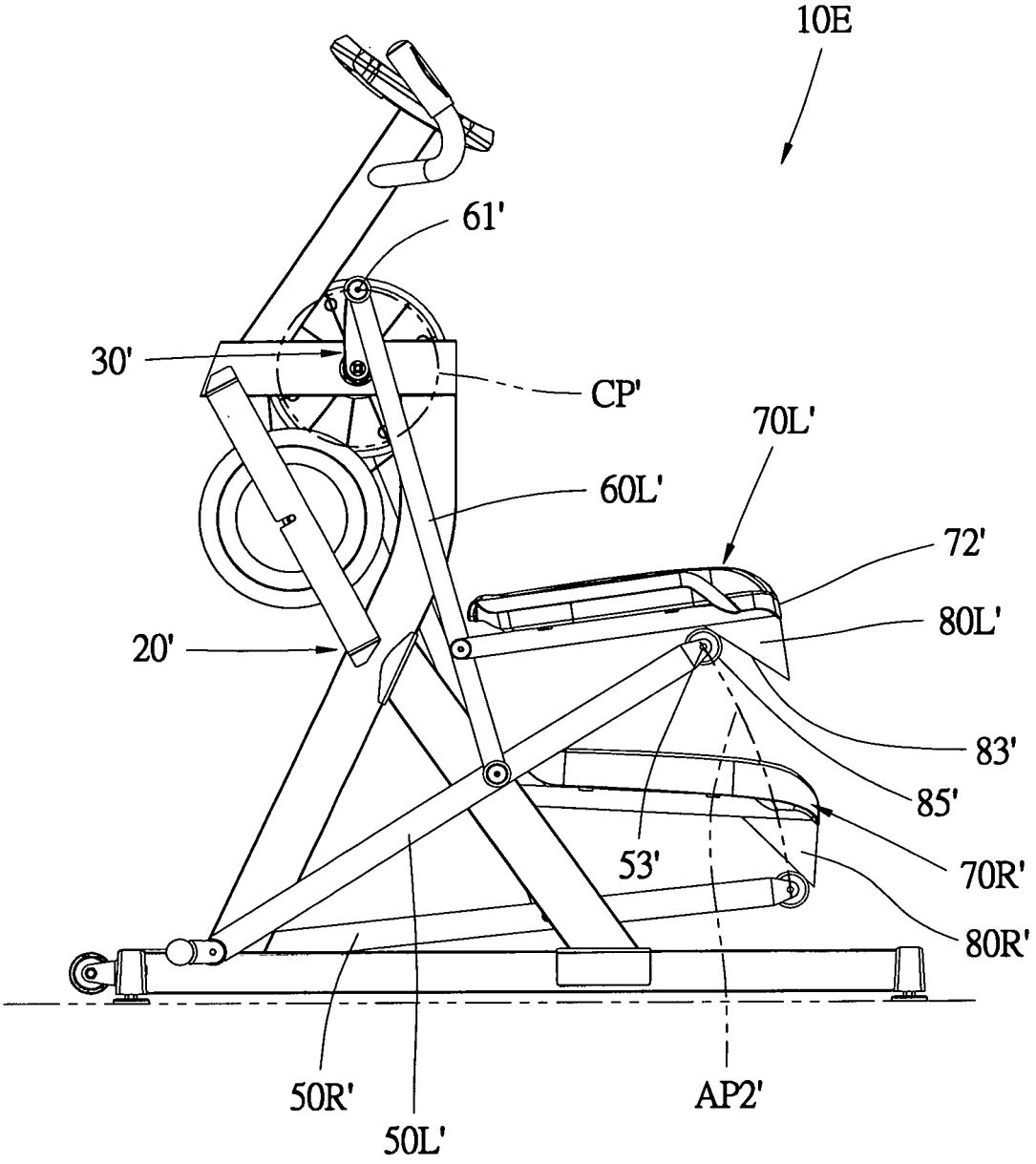
Figure 12:
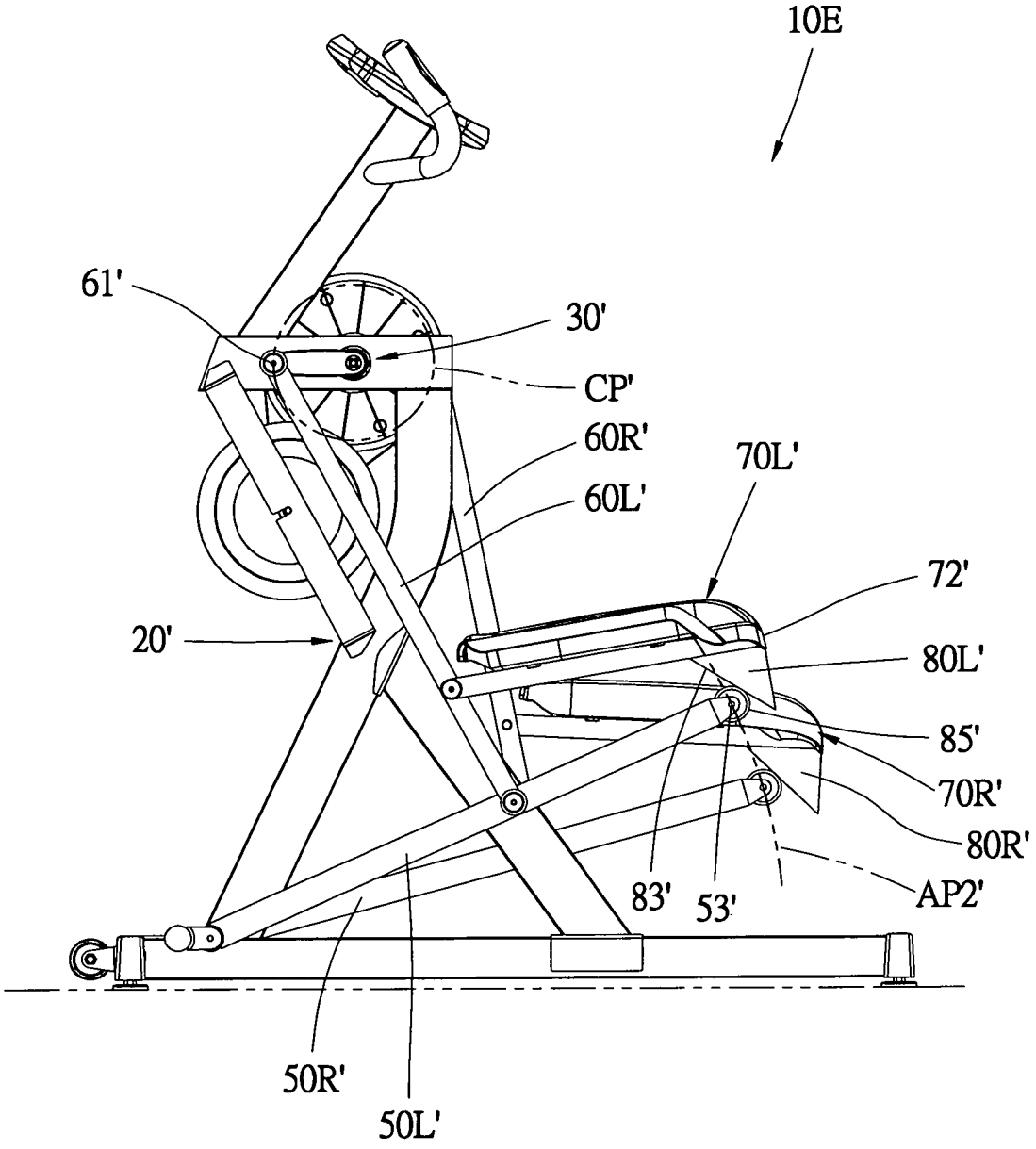
Figure 13:
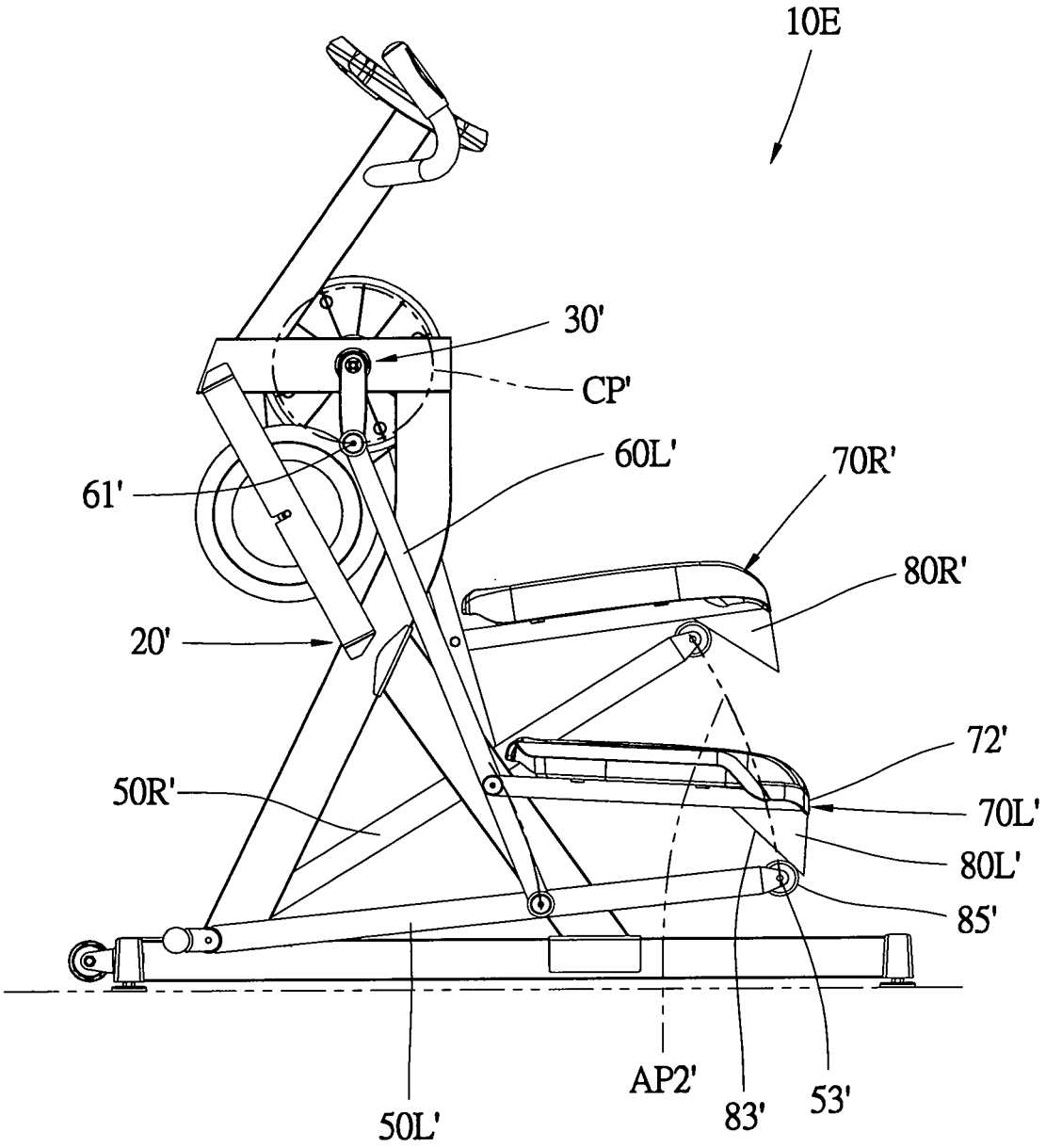
Figure 14:
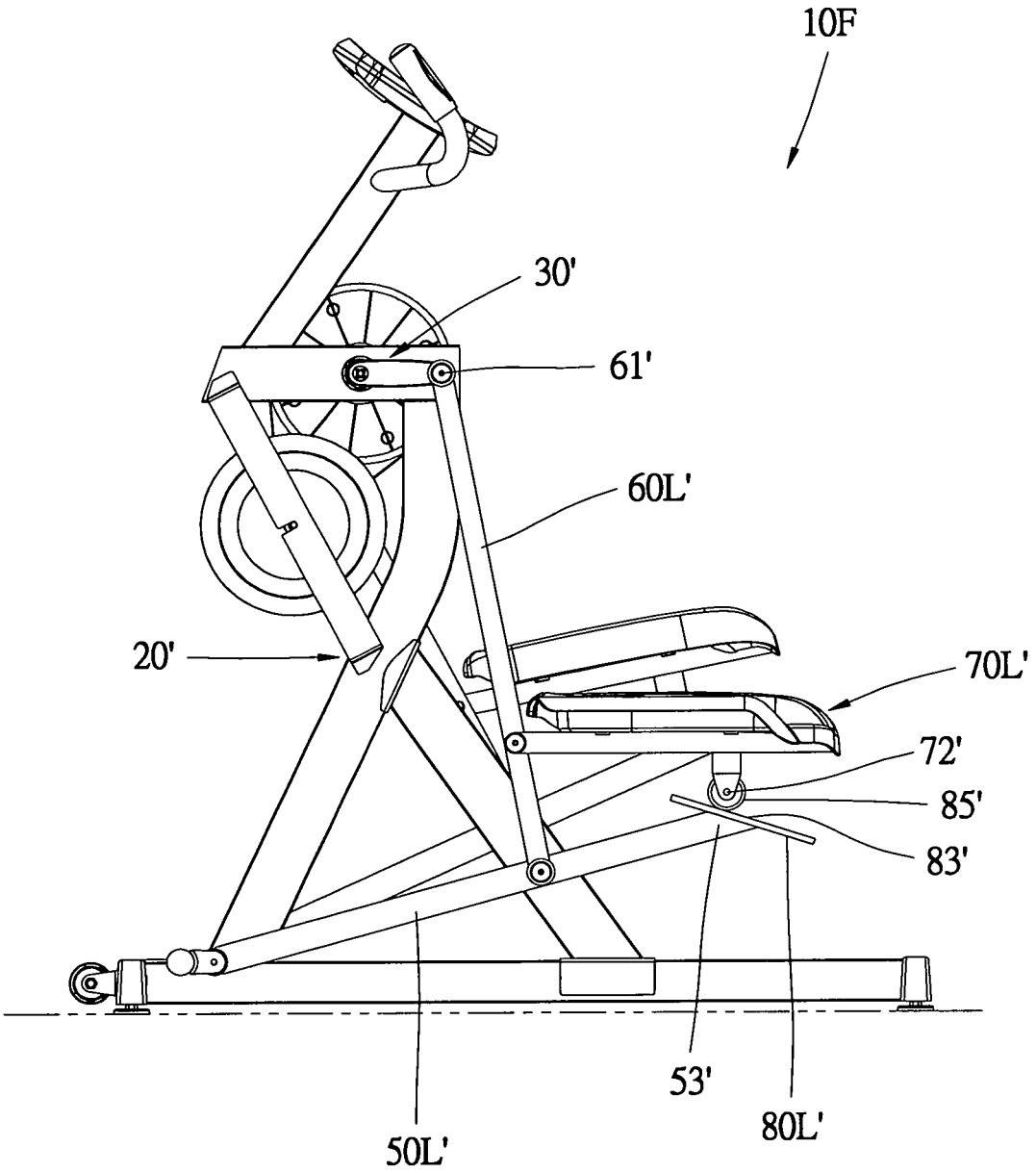
FIG. 14 illustrates a left side view of another modified embodiment of the stationary exercise apparatus according to the second preferred embodiment.

FIG. 14 shows a stationary exercise apparatus 10F which is a modified structure of the stationary exercise apparatus 10E shown in FIG. 10, and the difference therebetween is that the control member (represented by 80L') with sliding plane 83' is changed to be fixed to the third portion 53' of the swing member (represented by 50L'). Correspondingly, the supporting member (represented by 70L') has a roller 85' pivotally mounted on the second portion 72' of the supporting member 70L' for abutting against the sliding plane 83' and being configured to roll on the sliding plane 83'.

Figure 15:
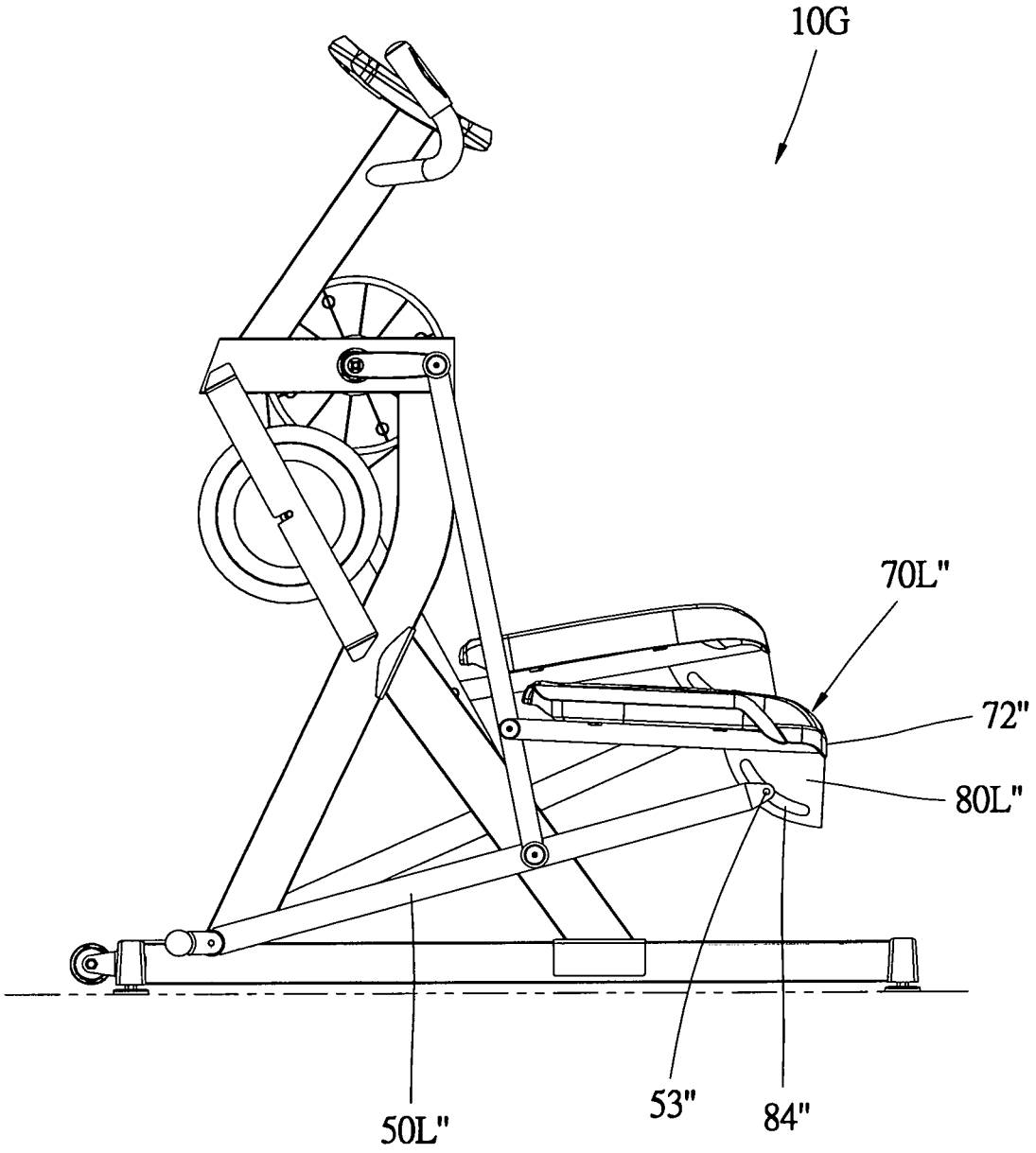
FIG. 15 is a left side view of a stationary exercise apparatus in accordance with a third preferred embodiment of the present invention.

Referring to FIG. 15, a stationary exercise apparatus 10G in accordance with a third preferred embodiment of the present invention is similar to the aforementioned embodiments, except that each control member (represented by 80L") has a guide track 84". Each control member 80L" is secured on one of the second portion 72" of the respective supporting member 70L" and the third portion 53" of the respective swing member 50L", and the other one is coupled to the guide track 84" for being movable along the guide track 84".

When using above stationary exercise apparatuses, the user can step on the left and right supporting members (foot platforms) with two feet and grip the handle set with two hands, and using both feet to alternately tread the left and right supporting members, such that the first/second portions of the left and right supporting members could cyclically move along the first/second closed path and kept opposite to each other. Therefore, the user is able to perform leg exercise that two legs are alternately moved up and down.

Compared with the prior art, the stationary exercise apparatus of the present invention has several advantages. First, the second portion of the supporting member (foot platform) and the third portion of the swing member are guided by the control member to move along a predetermined path, so that the angle of the supporting member relative to the connecting member are varied with the angle of the swing member relative to the connecting member, that is, the angular variation behavior and the angular variation range of each supporting member during the movement cycle are not necessarily related to the angular variation behavior and the vertical displacement of the corresponding connecting member during the movement cycle. Therefore, the aforementioned stationary apparatus is capable to achieve a longer stride length with a smaller (or within an appropriate range) angular variation of each foot platform. It is easier to optimize the angular variation behavior of the foot platform. In other words, the aforementioned stationary exercise apparatus can be designed according to requirements for proving the leg movement with a longer stride length, a higher lifting height, and the angular variation of the foot is controlled within an appropriate range.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A stationary exercise apparatus, comprising:

a frame;

a crank mechanism rotatably mounted on the frame about a first axis, wherein the first axis is oriented laterally with respect to the frame;

at least one connecting member having a first portion, a second portion and a third portion, wherein the first portion of the connecting member is coupled to the crank mechanism such that the crank mechanism guides the first portion of the connecting member to move along a circular path about the first axis;

at least one swing member having a first portion, a second portion and a third portion, the first portion of the swing member pivotally mounted on the frame about a second axis, the second axis being parallel to the first axis, the second portion of the swing member coupled to the second portion of the connecting member, wherein when the first portion of the connecting member moves along the circular path, the second portion of the connecting member moves along an arc-shaped path between a first endpoint and a second endpoint, and the third portion of the connecting member moves along a closed path;

at least one supporting member configured to support a user's foot, the supporting member having a first portion and a second portion, wherein the first portion of the supporting member is coupled to the third portion of the connecting member; and at least one control member arranged between the second portion of the supporting member and the third portion of the swing member to guide the second portion of the supporting member along a predetermined path.

2. The stationary exercise apparatus of claim 1, wherein the control member has a first portion and a second portion, the first portion of the control member coupled to the second portion of the supporting member and the second portion of the control member coupled to the third portion of the swing member.

3. The stationary exercise apparatus of claim 1, wherein a four-bar linkage mechanism is formed by a pivotal connection between the connecting member and the swing member, a pivotal connection between the swing member and the control member, a pivotal connection between the control member and the supporting member, and by a pivotal connection between the supporting member and the connecting member.

4. The stationary exercise apparatus of claim 1, wherein a four-bar linkage mechanism is formed by the connecting member, the swing member, the control member, and the supporting member, wherein there is a pivotal connection between the connecting member and the swing member, a pivotal connection between the swing member and the control member, a pivotal connection between the control member and the supporting member, and a pivotal connection between the supporting member and the connecting member.

5. The stationary exercise apparatus of claim 1, wherein the control member forms a sliding plane that is secured on the second portion of the supporting member, wherein a roller is pivotally mounted on the third portion of the swing member for abutting against the sliding plane of the control member, and wherein the roller is configured to roll on the sliding plane.

6. The stationary exercise apparatus of claim 1, wherein the control member forms a sliding plane secured on the third portion of the swing member, wherein a roller is pivotally mounted on the second portion of the supporting member for abutting against the sliding plane of the control member, and wherein the roller is configured to roll on the sliding plane.

7. The stationary exercise apparatus of claim 1, wherein the control member is secured on the second portion of the supporting member, wherein the control member forms a guide track, and wherein the third portion of the swing member is coupled to the guide track to guide the second portion of the supporting member with respect to the third portion of the swing member.

8. The stationary exercise apparatus of claim 1, wherein the control member has a guide track, the control member is secured on the third portion of the swing member, and the second portion of the supporting member is coupled to the guide track, wherein the guide track of the control member guides the second portion of the supporting member with respect to the third portion of the swing member.

9. The stationary exercise apparatus of claim 1, wherein the location of the first portion of the connecting member is higher than the location of the second portion of the connecting member, and wherein the location of the first portion of the connecting member is higher than the location of the third portion of the connecting member.

10. The stationary exercise apparatus of claim 1, wherein the arc-shaped path is located below a lowermost point of the circular path, and a line connecting the first endpoint and the second endpoint of the arc-shaped path defines an angle with a horizontal plane, wherein the angle between the line and the horizontal plane is greater than 45 degrees.

11. The stationary exercise apparatus of claim 1, wherein the closed path is located below the lowermost point of the circular path, and a vertical distance between uppermost and lowermost positions of the closed path is greater than the horizontal distance between foremost and rearmost positions of the closed path.

12. A stationary exercise apparatus, comprising:

a frame;

a crank mechanism rotatably mounted on the frame about a first axis, wherein the first axis is oriented laterally with respect to the frame;

two connecting members, each having a first portion, a second portion and a third portion, wherein the first portion of each of the two connecting members is coupled to the crank mechanism such that the crank mechanism guides the first portion of each of the two connecting members to move along a circular path with respect to the frame;

two swing members, each having a first portion, a second portion and a third portion, the first portion of each of the two swing members respectively pivotally mounted to the frame about a second axis, the second axis being parallel to the first axis, the second portion of each of the two swing members coupled to the second portion of the respective connecting member for guiding the second portion of each of the two connecting members to move along an arc-shaped path, wherein when the first portion of each of the two connecting members moves along the circular path, the second portion of ach connecting member each of the two connecting members moves along the arc-shaped path between a first endpoint and a second endpoint, and the third portion of each of the two connecting members moves along a closed path with respect to the frame;

two supporting members, each configured to support a user's foot, each of the two supporting members having a first portion and a second portion, the first portion of each of the two supporting members coupled to the third portion of the respective connecting member; and two control members, each arranged between the second portion of the corresponding supporting member and the third portion of the corresponding swing member, each of the two control members configured to guide the second portion of the corresponding supporting member along a predetermined path, so that an angle formed between each each of the two supporting members and the corresponding connecting member varies as the corresponding swing member moves along the arc-shaped path between a first endpoint and a second endpoint.

13. The stationary exercise apparatus of claim 12, wherein each of the two control members has a first portion and a second portion, the first portion of each of the two control members being coupled to the second portion of the corresponding supporting member and the second portion of each of the two control members being coupled to the third portion of the corresponding swing member.

14. The stationary exercise apparatus of claim 12, wherein a four-bar linkage mechanism is formed by each of the two connecting members, the corresponding swing member, the corresponding control member, and the corresponding supporting member, wherein there is a pivotal connection between each of two connecting members and the corresponding swing member, a pivotal connection between each of the two swing members and the corresponding control member, a pivotal connection between each of the two control members and the corresponding supporting member, and a pivotal connection between each of the two supporting members and the corresponding connecting member.

15. The stationary exercise apparatus of claim 12, wherein each of the two control members forms a sliding plane that is secured on the second portion of the respective supporting member, and wherein a roller is pivotally mounted on the third portion of each of the two swing members for abutting against the sliding plane of the respective control member and wherein each roller is configured to roll on the sliding plane.

16. The stationary exercise apparatus of claim 12, wherein each of the two control members forms a sliding plane secured on the third portion of the respective swing member, wherein a roller is pivotally mounted to the second portion of each of the two supporting members for abutting against the sliding plane of the respective control member and wherein each roller is configured to roll on the sliding plane.

17. The stationary exercise apparatus of claim 12, wherein each of the two control members is secured on the second portion of the respective supporting member, wherein each of the two control members forms a guide track, and wherein the third portion of the respective swing member is coupled to the guide track to guide the second portion of the respective supporting member with respect to the third portion of the respective swing member.

18. The stationary exercise apparatus of claim 12, wherein each of the two control members has a guide track, each of the two control members is secured on the third portion of the respective swing member, and the second portion of the respective supporting member is coupled to the guide track for being movable along the guide track.

19. The stationary exercise apparatus of claim 12, wherein the crank mechanism is configured to keep the first portions of the two connecting members 180 degrees opposite to each other on the circular path.

20. The stationary exercise apparatus of claim 12, wherein the position of the first portion of each of the two connecting members is located higher than the position of the second portion of the connecting member and wherein the position of the first portion of each of the two connecting members is located higher than the position of the third portion of the connecting member; where the arc-shaped path is located below a lowermost point of the circular path, and a line connecting the first endpoint and the second endpoint of the arc-shaped path defines an angle with a horizontal plane, wherein the angle between the line and the horizontal plane is greater than 45 degrees; and where the closed path is located below the lowermost point of the circular path, and a vertical distance between uppermost and lowermost positions of the closed path is greater than a horizontal distance between foremost and rearmost positions of the closed path.

* * * * *